United States Patent [19]

Cannaday

[11] 4,324,012

[45] Apr. 13, 1982

[54] CUSHIONING DEVICES

[76] Inventor: Sheridan S. Cannaday, 16640 122nd SE., Renton, Wash. 98055

[21] Appl. No.: 159,830

[22] Filed: Jun. 16, 1980

[51] Int. Cl.[3] ..... A47C 27/12; B68G 5/00

[52] U.S. Cl. ..... 5/432; 2/2; 2/19; 2/DIG. 1; 5/448; 66/170; 206/521; 224/212; 224/264; 297/453; 428/36; 428/64; 428/247; 428/253

[58] Field of Search ..... 5/432, 448; 297/453; 428/36, 64, 253, 247; 2/2, 19, DIG. 1; 206/521; 224/212, 264; 66/170

[56] References Cited

U.S. PATENT DOCUMENTS

| | | | |
|---|---|---|---|
| 1,533,868 | 4/1925 | Kingman | 66/170 |
| 2,332,957 | 10/1943 | Weisglass | 5/448 |
| 3,513,492 | 5/1970 | Phillips | 297/453 |
| 4,108,492 | 8/1978 | Kirby | 5/432 |
| 4,189,180 | 2/1980 | Klein | 297/453 |

*Primary Examiner*—Alexander Grosz
*Attorney, Agent, or Firm*—Delbert J. Barnard

[57] ABSTRACT

A light weight, ventilated, moisture resistant cushion on which there are opposite facings having multiple openings, such as in a net fabric, for the passage of air. The facings define a pocket between them, and each pocket is adapted to carry and restrain a pad which may be constructed from a jersey knit plastic fabric, rolled onto itself to form at least one roll of the pad fabric. The opposite facings contact opposite surface portions of the roll or rolls so that any load imposed to a facing of the cushion tends to flatten the roll a direction transverse to the center line or axis thereof. The strands of the knitted fabric forming the rolls are relatively stiff and when loaded bend and when unloaded, although not per se resilient, recover like springs.

32 Claims, 22 Drawing Figures

Fig. 1
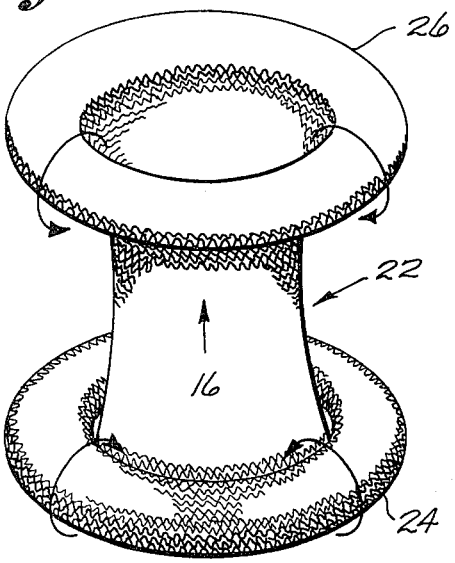
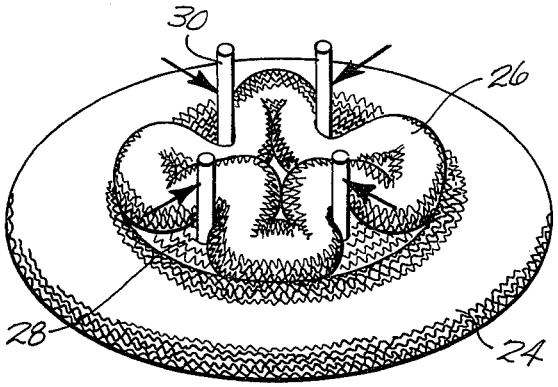
Fig. 2
Fig. 15
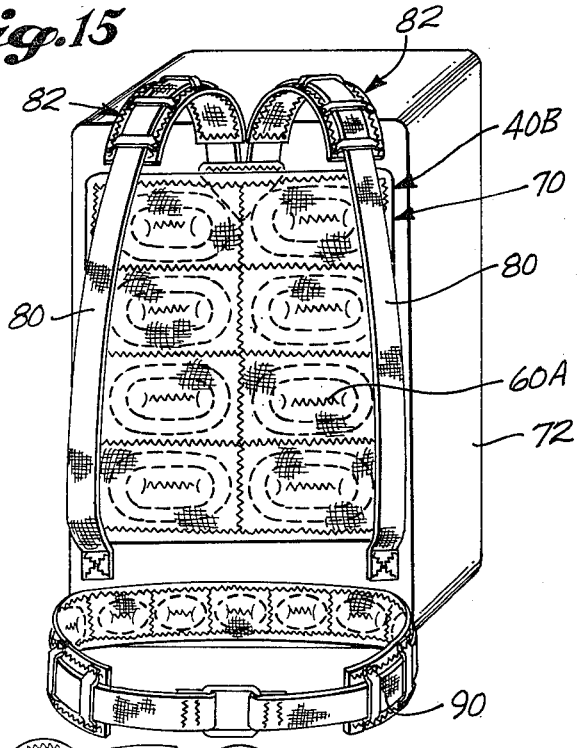
Fig. 16
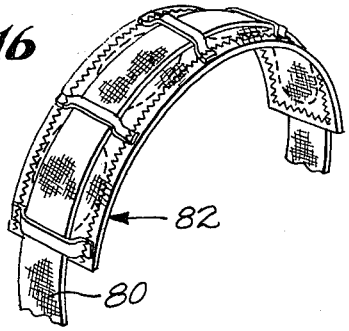
Fig. 17
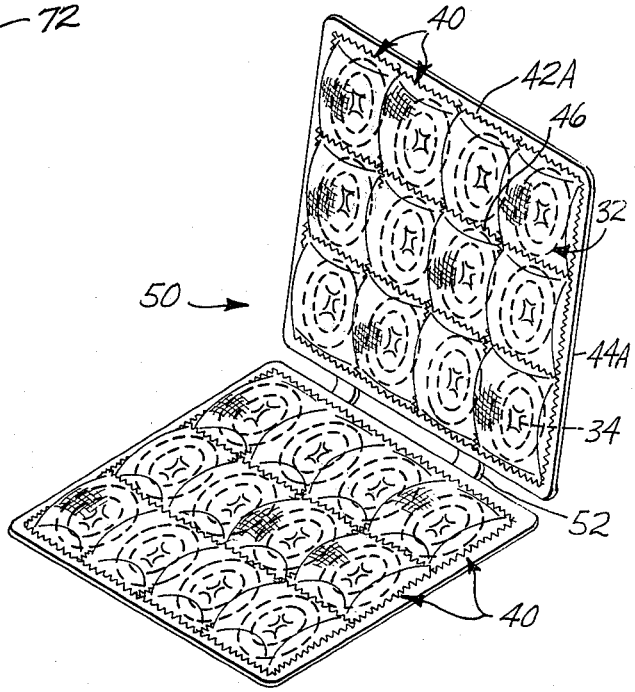
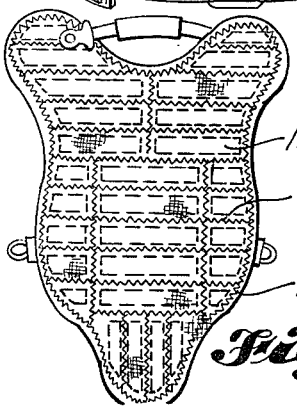
Fig. 18

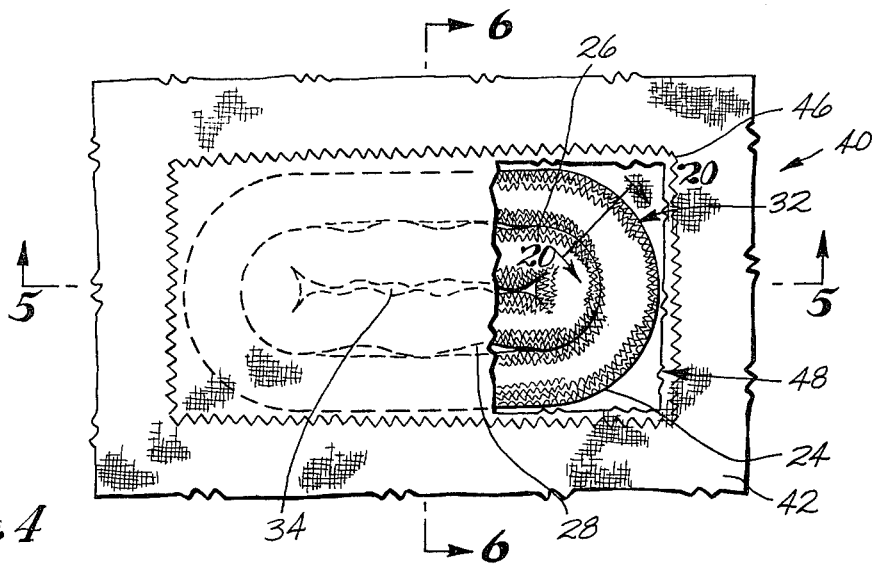
Fig. 4
Fig. 5
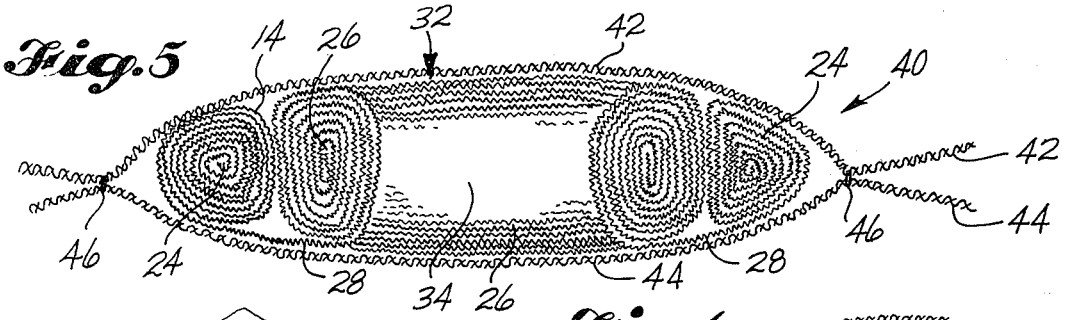
Fig. 6
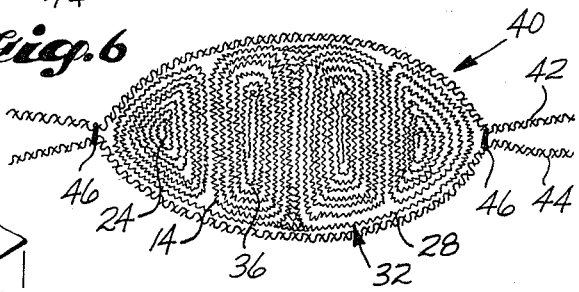
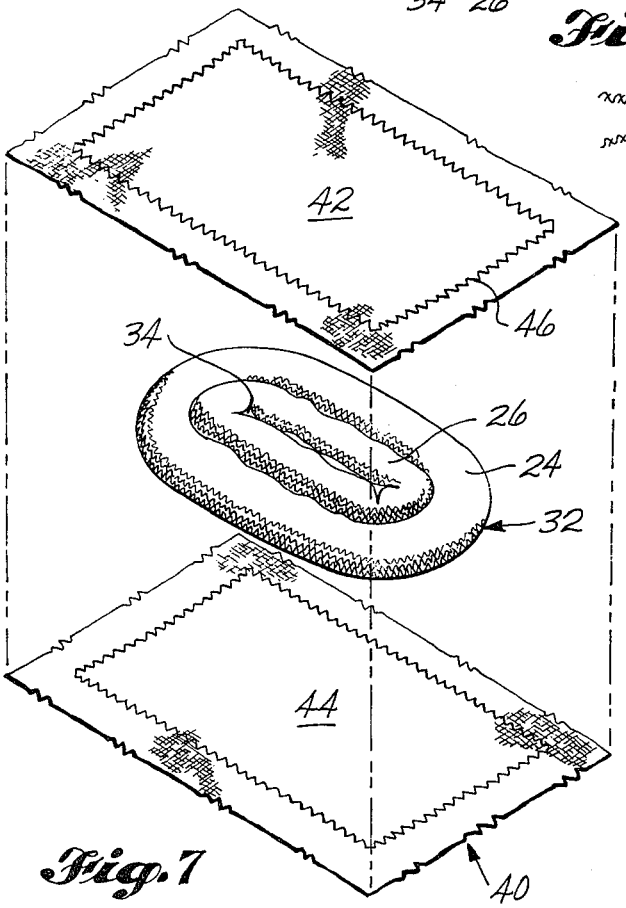
Fig. 7
Fig. 3
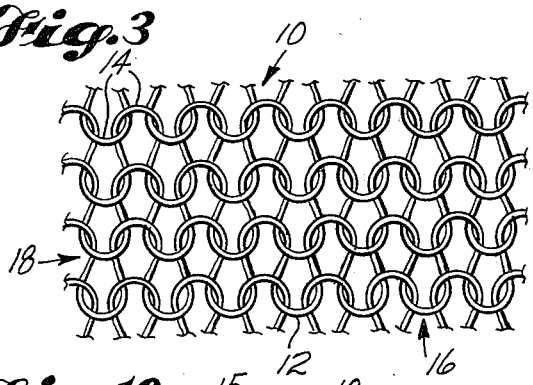
Fig. 19
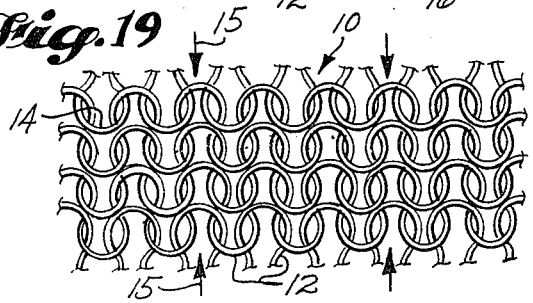

CUSHIONING DEVICES

BACKGROUND OF THE INVENTION

The invention relates to cushions and cushioned devices such as seat cushions for automobiles, mattress pads for sleeping bags, protective jackets for motorcycle riders, padded straps, baseball catcher and umpire chest protectors, inexpensive baseball mitts, and cushions for use in back packing between the back of the user and his pack, for example.

In the prior art ventilated cushions were frequently made for example, as shown in a U.S. Pat. No. 1,911,276, in which the ventilating and cushioning device was a spiral coil of spring wire. Those devices were relatively expensive to made and had the disadvantages of causing wear to the upholstery and to the clothes of the user, particularily, when the cushions began to wear and metal parts would extend through the covering material.

Other devices in the prior art such as baseball catcher and umpire chest protectors and backpacks have not been ventilated and have been extremely hot to wear. In addition they absorb moisture and are subject to mildew.

SUMMARY OF THE INVENTION

The present invention is a light weight, inexpensive, resilient, ventilated, moisture resistant cushioning device made in the form of individual pads fitted into individual pockets. The pockets are made having opposite facings with a multiple number of ventilating openings such as found in a net fabric. The pockets are sized peripherally to restrain a pad under load. The pads are made of knitted plastic rolled onto itself to form a one or more rolls. Typically, there are a plurality of rolls juxtaposed and fitted within a pocket.

To make a typical cushion, a plurality of pockets, each having a pad therein, are positioned in adjacent. Such a cushion may be made of two opposite sheets, secured together around each individual pad.

The loads on the opposite facings are applied to opposite surface portions of the pad rolls so that any load imposed on a facing tends to flatten the roll or rolls in a direction transverse to that of the roll axis or center line. The strands of the knitted fabirc are relatively stiff and when loaded, as above, bend and then, when unloaded behave like springs and cause the rolls and pads to return to their unloaded shape.

Accordingly, it is an object of the present invention to provide an improved cushion which permits free air passage therethrough even when loaded a very substantial amount and up to the condition where the cushion would be crushed, which would not occur in normal use.

It is another object of the invention to provide a cushion, as described in the preceding paragraph, in which sharp corners and cutting edges as found in the prior art are eliminated.

It is still another object of the present invention to provide a cushion, as described in the preceding paragraphs, which protects the user against direct heat transfer. The present invention transfers very little heat, if any, and also permits the cooling effect of continual ventilation under all normal loads.

It is further object of the invention to provide cushion pads made of juxtaposed rolls and/or rolls fitted within each other. The fabric of which rolls are made is formed of relatively stiff plastic strands which are neither elastic nor resilient. Thus, when a load is received by a roll or rolls, the pad compresses or flattens to the extent of the looseness of the knit and the flexibility of the strands. In so flattening under a load, the adjacent layers of rolls contact each other and compress until they will no longer flatten. They then behave as a solid member, but continue to ventilate.

A further advantage of the solid condition, when developed by a concentrated or point load is that the load is not felt as such by a person's body located on the side of the cushion opposite the applied load.

The pads do not compress in a linear fashion because as they receive a load the material in the rolls interferes with itself. They are also nonlinear in compression because the pads are restrained peripherally within the individual pockets. Thus, the pads compress only a limited amount and this makes the resilience possible.

The pockets and pad material may be made from various relatively stiff nonelastic and nonresilient plastics, such as nylon, Teflon or Delrin. The pocket material is preferably made of a knit which does not stretch so as to provide optimum containment of the pads. The materials used are washable, fire resistant, and not subject to mildew.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 1 is an isometric view of jersey knit plastic strands in tubular form being rolled on itself from both ends to form a pad according to the invention;

FIG. 2 is an isometric view of the tubular member in FIG. 1 after it has been rolled together from both ends so that one of the rolls fits within the other;

FIG. 3 is a plan view of a jersey knit fabric used in forming pads in the invention;

FIG. 4 is a plan view of a cushioning pad formed, as indicated as in FIGS. 1 and 2, and secured and retained within a pocket having opposite facings;

FIG. 5 is a cross-sectional view of a pad and retaining pocket taken along the line 5—5 in FIG. 4;

FIG. 6 is a cross-sectional view of the pocket and pad taken along the line 6—6 in FIG. 4;

FIG. 7 is an exploded view of the pad and the pocket forming facings;

FIG. 15 is an isometric view of a backpack in which an embodiment of the invention is positioned to be between the pack and the wearer;

FIG. 16 is an isometric view of a strap cushioned by an embodiment of the invention;

FIG. 17 is an isometric view of a seat cushion and backrest as may be used in automobiles;

FIG. 18 is an elevational view of a baseball catcher's chest protector including the embodiment shown in FIG. 12;

FIG. 19 is a view similar to FIG. 3 in which the knit is under slight compression in the plane thereof;

DESCRIPTION OF THE PREFERRED EMBODIMENTS

Figure 8:
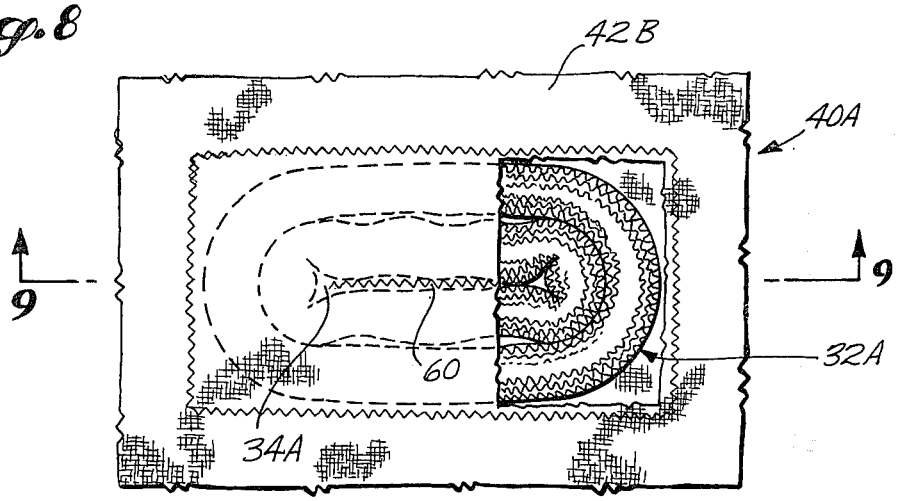
FIG. 8 is a plan view similar to FIG. 4 in which a pad having an elongated central slit has been stitched together through the pocket forming facings.

Referring again to the drawings, in FIGS. 1–3 the making of one type of cushioning pad according to the invention is illustrated. In FIG. 3 a jersey knit plastic fabric 10 is made of relatively stiff strands 12. The strands are nonelastic and nonresilient and may be of various shapes in cross section, cylindrical being the most economical. The knit is formed by intermeshing loops 14. Each row of loops at right angles to the direction in which the fabric is produced is a course. Each row parallel to the direction in which the fabric is produced is a wale. The wales, indicated by the arrow 16, are vertical and the courses, indicated by the arrow 18 are horizontal. The fabric in FIG. 3 is generally in a single plane and is without load. In FIG. 19 the same fabric is under slight load in its plane as indicated by the arrows 15, the loops 14 having moved into contact.

In FIG. 1 a single jersey knit, as 10, has been produced in tubular form 22 and the wales 16 extend in the vertical direction as shown in FIG. 3. To form a pad of the invention, the tubular fabric is rolled from both ends, as illustrated by the rolls 24 and 26. The roll 24 is designed to be the biffer roll, and the roll 26 the smaller, so as it will fit into the roll 24, FIG. 2. The two rolls generally form two donuts which are connected by lower generally flat layer 28.

In FIG. 2 four pins 30 of a jig are located to ease the positioning of the roll 26 within an inner surface of the roll 24. After the smaller roll is inserted as shown in FIG. 4, the pins are removed. The rolls 24 and 26 are inherently more nearly circular than shown in FIG. 4 where they have been elongated to form a pad 32. In this relationship the rolls are juxtaposed, many surface areas being in contact and other surface areas being slightly spaced from each other. In this pad formation, there is a central elongated space 34, the width being dependent upon the containment of the pad.

A pad 32 is fitted within a pocket 40, FIGS. 4–7, formed of two opposing facing sheets 42 and 44, stitched as at 46 to form an enclosing and restraining oblong 48. The enclosing stitches 46 restrain the pad under a load so as to increase its resiliency.

As shown in FIG. 17, a multiple of the pockets 40 may be made from two large sheets 42A and 44A where stitching 46 forms a multiple of oblong pockets with pads 32 in each one. From the multiple pads and pockets an automobile seat cushion 50 is formed, hinged together with two straps 52 to attach the seat and backrest. The sheets 42 and 44 may be made of nylon knit or mesh to provide for flow of air therethrough and through the knit openings in the fabric 10, FIG. 3, in the pad. Nylon facings 42 and 44 do not stretch and serve to adequately contain the pads under loads.

As may be seen from FIGS. 4–7, 17, 20 and 21, a person sitting on a seat cushion 50 and leaning against the back thereof imposes a load approximately normal to the facings of the cushion which form the pockets. When unloaded, the pad and pockets are generally of oval shape, FIGS. 5, 6, and 20, and under load, this shape is generally maintained although the pads and their rolls 24 and 26 are generally flattened in a transverse direction with respect to their centers or axes which are all approximately in the same plane.

Figure 21:
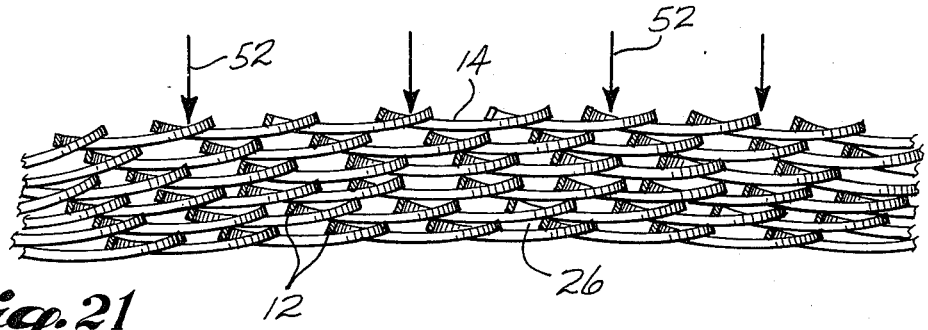
FIG. 21 is a view of the cushion portion in FIG. 20 under load so as to behave as a solid having air passages.

As the load increases, as indicated by the arrows 52, FIG. 21, the rolls flatten until all of the strands 12 of the fabric make contact with adjacent strands above and below. The individual strands 12 bend as long as space exits. They are not in of themselves resilient or elastic and are not compressible. As a result, the pads compress or flatten to the extent permitted by the contacting of the knit-formed loops 14 so as to fill the spaces, FIGS. 5 and 20, which exist between the various layers of knitted fabric forming the rolls.

Figure 22:
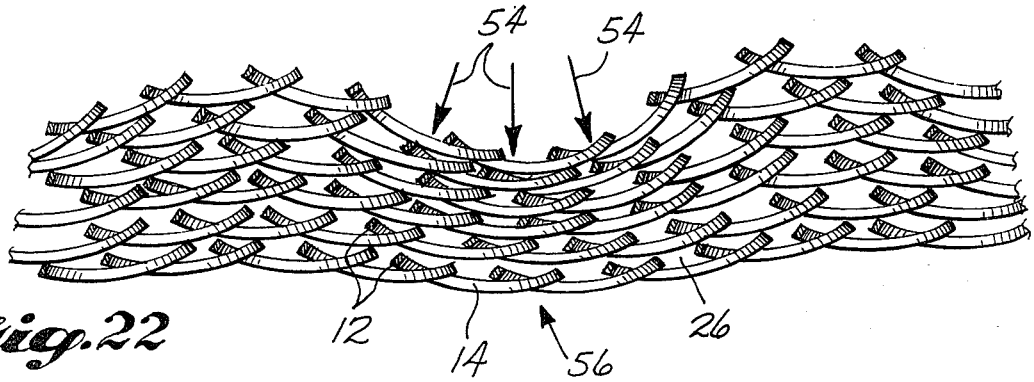
FIG. 22 is a view of a cushion portion under a point load and illustrating the distribution of the load.

When the rolls have flattened so that the layers are in contact with those above and below, FIG. 21, the rolls will no longer compress and behave similar to a solid member with respect to the way it receives a loading force. This is an important characteristic of the cushion in that a concentrated or point load, indicated by the arrows 54 in FIG. 22, compresses the pad, but when the strands of the pad bottom out, the load is distributed in a limited volume of the pad which behaves as a solid portion. Thus, a concentrated or point load is not felt as such by a person's body located on a side 56 of the cushion opposite the point load, but is felt only as a laterally distributed pressure in the solid portion.

In addition, even though all of the layers of the pad are in a pressure relationship, above and below, most of the air space initially provided by the loops of the knit is not closed, FIG. 21. Therefore, the pad continues to provide ventilation therethrough and through the pocket forming surfaces both vertically and through the ovoidal surfaces adjacent the stitching 46, FIGS. 5 and 6.

Loads on the pads do not compress them in a linear manner because the layers interfere with themselves and cause the pad to bottom out as though it were a solid material, as described. This creates the resiliency which is further enhanced by the containment of the individual pads in their pockets. That is, they cannot be flattened to extend laterally beyond the limitation provided by the pocket stitching and the energy stored in the contained and compressed strands produces greater resiliency.

The resiliency of the pads is a function of the length of a tube, such as 22, FIG. 1. For example, a 14 inch length tube will make a more resilient pad than a 16 inch length tube. However, a longer tube provides a thicker cushion with more protection and more space for lateral airflow, as can be envisioned in FIG. 6.

Figure 9:
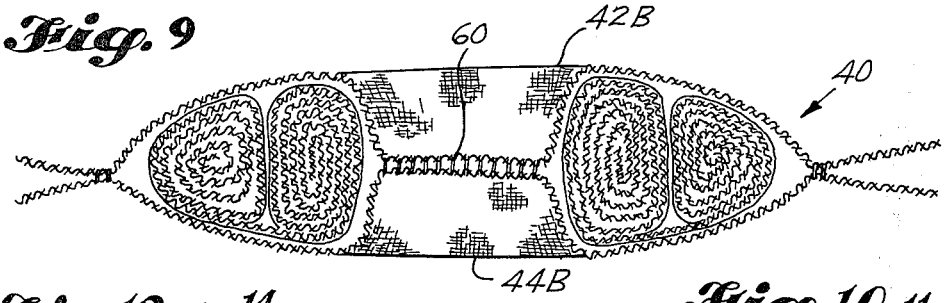
FIG. 9 is a cross-sectional view taken along the line 9—9 in FIG. 8.

In FIGS. 8 and 9, a pocket 40A and pad 32A are varied from these shown in FIGS. 4–7. The variation is in the form of stitching 60 through the layers 42B and 44B so as to sew up the elongated opening 34 and make closed area 34A. The stitching 60 further restrains the lateral movement of the pad under load and thereby increases its resiliency. The stitching also prevents the possibility of point loads extending through an opening, as 32, which may not be necessarily limited to the narrow elongated form shown in FIG. 4. It should be noted that in a seat cushion, FIG. 17, that the considerable space apparent at the corners of the stitching 46 does not present a problem in that the load is sustained on the various pads, and no load is generally presented in the spaces between the various pads.

In FIG. 15, a backpacking cushion 70 is made of pockets 40B, and having stitching 60A to close the central openings in the various pads and pockets. The cushion 70 is either attached to the backpack 72 or to part thereof, or may be added on to the original structure and secured to the backpack front face. In the latter arrangement, there is no requirement for a second facing (backing) sheet, as the sheet 44 in the pocket 40, FIG. 7, a facing 42 only being required. In such a situation, lateral and front face airflows provide adaquate ventilation.

The behavior of the pads as solid members, after space removing compression of the rolls, is particularly important in a backpack because the pack contains various items such as cans which present concentrated or point loads that typically would dig into the carrier's back if it were not for the performance of the present invention. Thus, when the strands of the individual rolls bottom out, the load is distributed so that the point load is not felt. Under all circumstances, ventilation is available for cooling the carrier's back.

In FIGS. 15 and 16, shoulder straps 80 are provided with cushions 82 which may be in the form of the pocket and pads shown in FIG. 4 or 8. Here the individual pockets 40 or 40A are stitched together or formed of one piece of upper and lower facings 42 and 44 to form a single row of pads to relieve the load on the shoulders and to provide cooling ventilation to the shoulder area.

Similar to the shoulder cushion in FIG. 16, a padded belt 90 is attached to the lower part of the pack 72 in FIG. 15. Here again the individual pads such as 40 or 40A are sewn together or otherwise positioned end-to-end to fit around the body for about 270° to provide a cushioning and cooling effect when the belt makes contact with the wearer.

Figure 10:
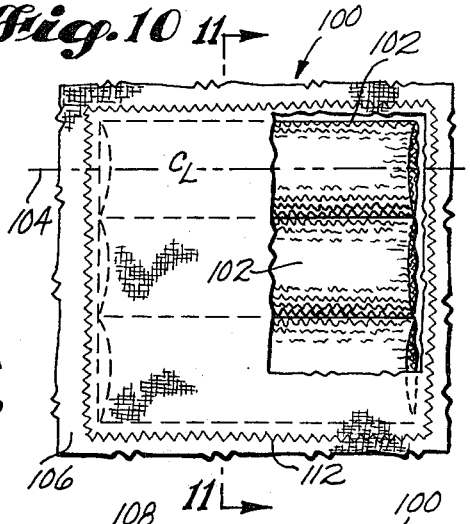
FIG. 10 is a plan view of an alternate embodiment of the invention in which the pad is formed of separate, contiguous rolls of jersey knit material.
Figure 11:
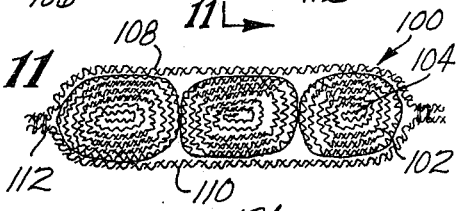
FIG. 11 is a cross-sectional view taken along the line 11—11 of FIG. 10.

In FIGS. 10 and 11 another form of cushioning pad 100 is illustrated. The knitted fabric forming the rolls may be the same as that shown in FIG. 3 but in this situation the rolls 102 are formed from a sheet of knitted fabric rolled along a center line as 104, the sheet being rolled upon itself starting at the center line. The three individual rolls are in juxtaposition and are generally contiguous with the roll next thereto so as to be relatively snugly contained within a pocket 106 formed by two mesh sheets 108 and 110 secured together by stitching 112 to form the padding. The center lines 104 are approximately in the same plane. The air passes through the various rolls under pressure and through the mesh sheets in the same manner as in the pads and pockets described above.

Figure 12:
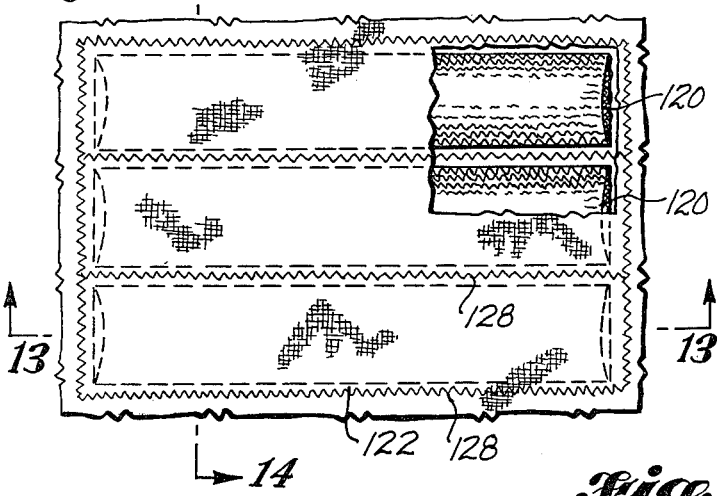
FIG. 12 is a plan view of pads formed of individual rolls separated by stitching through the pocket.
Figure 13:
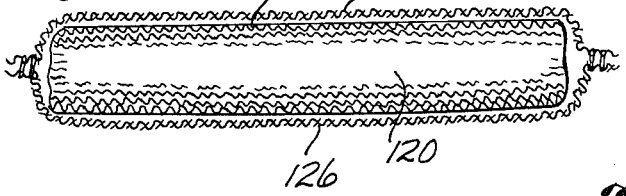
FIG. 13 is a sectional view taken along the line 13—13 in FIG. 12.
Figure 14:
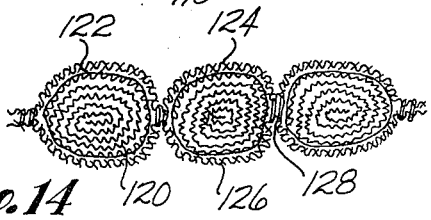
FIG. 14 is a sectional view taken along the line 14—14 in FIG. 12.
Figure 20:
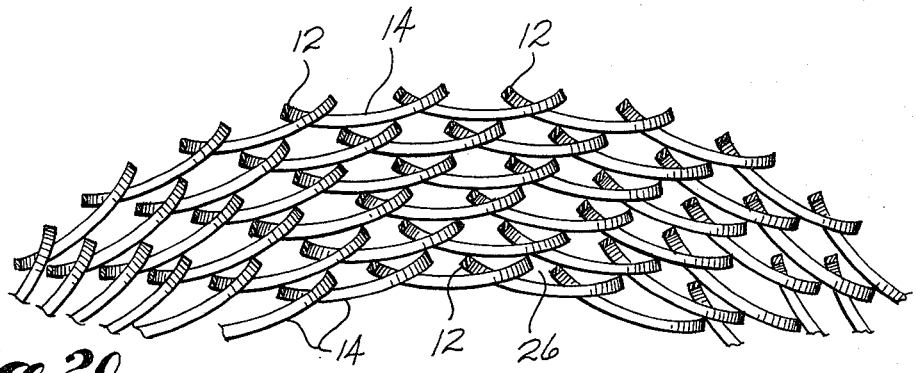
FIG. 20 is an enlarged fragmentary, partially sectional view of an unloaded cushion portion taken along the line 20—20 of FIG. 4.

In FIGS. 12–14 the rolls 120 are formed in the same way as the rolls 102. They are contained in individual pockets 122, each of the pockets having an upper and lower mesh sheet 124 and 126. Each roll and pocket are separated by a row of stitching 128. In this arrangement each roll 120 is relatively snugly contained when under a load within the elongated pockets 122. The individual rolls are as closely positioned together as desired and are only required to be spaced apart sufficiently to permit the stitching 128 therebetween. In this situation each roll forms an individual pad.

As shown in FIG. 18, the above pad arrangement is particularly adaptable for chest protectors for baseball catchers and umpires, for example. Because the rolls may be very closely positioned, as indicated in FIG. 14, a concentrated or point load which would be effected by a fast moving baseball against the chest protector would be minimized against the chest of the wearer because of the action of the rolls under such loads. Such a chest protector also provides the additonal advantage of being ventilated so as to have a continual cooling effect on the wearer.

It should be noted that a padding arrangement as shown in FIG. 12 or FIG. 10 could also be advantageously used to manufacture inexpensive baseball mitts. Such mitts would restrain the point loads received in catching a baseball and also keep the hand cool. The economy in such a mitt would be particularly beneficial in that leather mitts have become very expensive and purchase had been limited or precluded by members of lower economic groups. Another advantage of a mitt according to the present invention over leather is that it does not mildew when it becomes moist as is the case with typical athletic equipment.

The invention and its attendant advantages will be understood from the foregoing description and it will be apparent that various changes may be made in the form, construction, and arrangement of the parts of the invention without departing from the spirit and scope thereof or sacrificing its material advantages, the arrangements hereinbefore described being merely by way of example. I do not wish to be restricted to the specific form shown or uses mentioned except as defined in the accompanying claims.

What is claimed is:

1. A light weight, air cooled, moisture resistant cushion, comprising:

opposite facings of open mesh net fabric defining a pad receiving and restraining pocket between them; and a pad within said pocket which is constructed from a knitted plastic fabric, rolled onto itself to form at least one roll of said fabric, wherein said opposite facings contact diametrically opposite surface portions of the roll so that any loads imposed normally to a facing of the cushion will tend to flatten the roll in a transverse direction, and wherein the strands of said knitted fabric are relatively stiff and when loaded will bend, and recover like springs when unloaded.

2. The invention according to claim 1 in which:

each pad has a plurality of juxtaposed rolls.

3. The invention according to claim 2 in which: each of said rolls has its center in approximately the same plane.

4. The invention according to claim 2 in which:

said rolls are formed separately on central lines;

said rolls being contiguous and said central lines being generally congruent.

5. The invention according to claim 2 in which:

said rolls are formed separately along central lines;

said rolls being adjacent, said central lines being generally congruent;

said opposite facings being secured together through regions of adjacency of the rolls.

6. The invention according to claim 2 in which:

said knitted fabric is formed as a tube, said rolls being formed by rolling the tube ends inwardly toward each other;

a roll from one end being larger than the roll from the other end, said smaller roll being fitted within said larger roll, said pocket being generally oblong so that said rolls are elongated, having a central elongated opening therein.

7. The invention according to claim 6 in which:

stitching through said opposite facings substantially closes said opening.

8. The invention according to claim 1 in which:

point loads are limited in depth in each roll as the roll is flattened so as not to be felt through the roll as a point load.

9. The invention according to claim 1 in which:

the strands of said fabrics are nonelastic and nonresilient.

10. The invention according to claim 1 in which:

a multiple of said pockets with pads therein are formed together to define a generally two-sided cushioning device.

11. The invention according to claim 10 in which:

said pockets and pads in said device are generally contiguous so as to provide in effect a continuous cushioning layer.

12. The invention according to claim 10 in which:

a plurality of said pockets are formed together, end-to-end, to define an elongated cushioning strap.

13. The invention according to claim 10 in which:

said pads in said cushioning device are spaced from each other;

said opposite facings being secured together along the edges of the pockets.

14. The invention according to claim 13 in which:

a pair of said cushioning devices are hinged together to form a seat and back cushion.

15. The invention according to claim 13 in which:

said cushioning device is secured to a backpack to fit against the back of the wearer.

16. A light weight, resilient, ventilated, moisture resistant cushion, comprising:

a cushion knitted pad formed from a fabric;

said fabric being rolled upon itself to form at least one roll;

a container for enclosing and restraining said roll so as to maintain the general shape of the roll under compression;

said container having opposing faces having a multiple of openings through at least one of said faces for the passage of air therethrough.

17. The invention according to claim 16 in which:

a plurality of said rolls are juxtaposed;

said container restraining said rolls as juxtaposed.

18. The invention according to claim 17 in which:

said rolls are formed separately on central lines;

said rolls being contiguous, said central lines being generally congruent.

19. The invention according to claim 17 in which:

said knitted fabric is formed as a tube;

said rolls being formed by rolling the tube ends inwardly toward each other;

a roll from one end being larger than the roll from the other end, said smaller roll being fitted within said larger roll;

said rolls being restrained in said container;

said container being generally oblong so that said rolls are elongated, having a central elongated opening therein.

20. The invention according to claim 19 in which:

stitching through said opposing faces of said container substantially closes said opening.

21. The invention according to claim 19 in which:

said container is generally oval in cross section in directions generally perpendicular to the sides of the oblong.

22. The invention according to claim 19 in which:

said rolled fabric interferes with itself in compression so that the compression is limited;

said rolls distributing loads in compression as contained so that point loads are not felt through the cushion as such.

23. The invention according to claim 22 in which:

a multiple of said cushion pads are formed together to define a generally two-sided cushioning device.

24. The invention according to claim 23 in which:

said cushion pads in said cushioning device are generally contiguous so as to provide in effect a continuous cushioning layer.

25. The invention according to claim 22 in which:

said cushion pads in said cushioning device are spaced form each other;

said opposing faces of said containers being secured together along the edges of the pads.

26. The invention according to claim 25 in which:

a pair of said cushioning devices are hinged together to form a seat and back cushion.

27. The invention according to claim 25 in which:

said cushioning device is secured to a backpack to fit against the back of the wearer.

28. The invention according to claim 22 in which:

a plurality of said containers and cushion pads are formed together, end-to-end, to define an elongated cushioning strap.

29. The invention according to claim 16 in which:

said rolled knitted fabric is compressible with a noncrushing force to cause each layer of a roll to make pressure contacts with adjacent layers;

said roll being resilient from said pressure contacts according to the spacing of the knit and the relative stiffness of the material.

30. The invention according to claim 16 in which:

said fabric is knitted from nonelastic and nonresilient strands, said rolled fabric interfering with itself under load so as to be nonlinear in compression.

31. The invention according to claim 16 in which:

said roll distributes compression loads to a limited depth so that point loads are not felt through the cushion as such.

32. The invention according to claim 31 in which:

said rolls are formed separately along central lines;

said rolls being adjacent, said central lines being generally congruent;

said opposing faces of said containers extending over the regions of adjacency of the rolls;

said opposing faces being secured together through said regions of adjacency.

* * * * *